US005593148A

United States Patent [19]

Hansch

[11] Patent Number: 5,593,148

[45] Date of Patent: Jan. 14, 1997

[54] PROCESS AND APPARATUS FOR COLLECTING PRINTED PRODUCTS

[75] Inventor: Egon Hansch, Wetzikon, Switzerland

[73] Assignee: Ferag AG, Switzerland

[21] Appl. No.: 449,348

[22] Filed: May 24, 1995

[30] Foreign Application Priority Data

Jun. 23, 1994 [CH] Switzerland ..... 02007/94

[51] Int. Cl.[6] ..... B65H 39/065

[52] U.S. Cl. ..... 270/52.3

[58] Field of Search ..... 270/52.26, 52.27, 270/52.29, 52.3

[56] References Cited

U.S. PATENT DOCUMENTS 4,058,202 11/1977 Reist et al. .
4,684,116 8/1987 Hansch ..... 270/54
4,811,938 3/1989 Hansch ..... 270/54
5,052,666 10/1991 Hansch ..... 270/55
5,052,667 10/1991 Hansch ..... 270/55
5,116,033 5/1992 Honegger ..... 270/55
5,292,110 3/1994 Honegger ..... 270/55
5,324,014 6/1994 Honegger et al. .

*Primary Examiner*—John E. Ryznic
*Attorney, Agent, or Firm*—Brinks Hofer Gilson & Lione

[57] ABSTRACT

Folded printed products are deposited in a straddling manner by feeding stations onto the rests circulating in a circulating direction along a continuous circulatory path. After being deposited, a second and third printed products project with a border portion beyond the trailing and leading edge, respectively, of a first printed product. When the printed products are being advanced in the conveying direction by means of drivers, which move back and forth, the printed products deposited one upon the other are aligned, interacting with a stop element in the process.

10 Claims, 3 Drawing Sheets

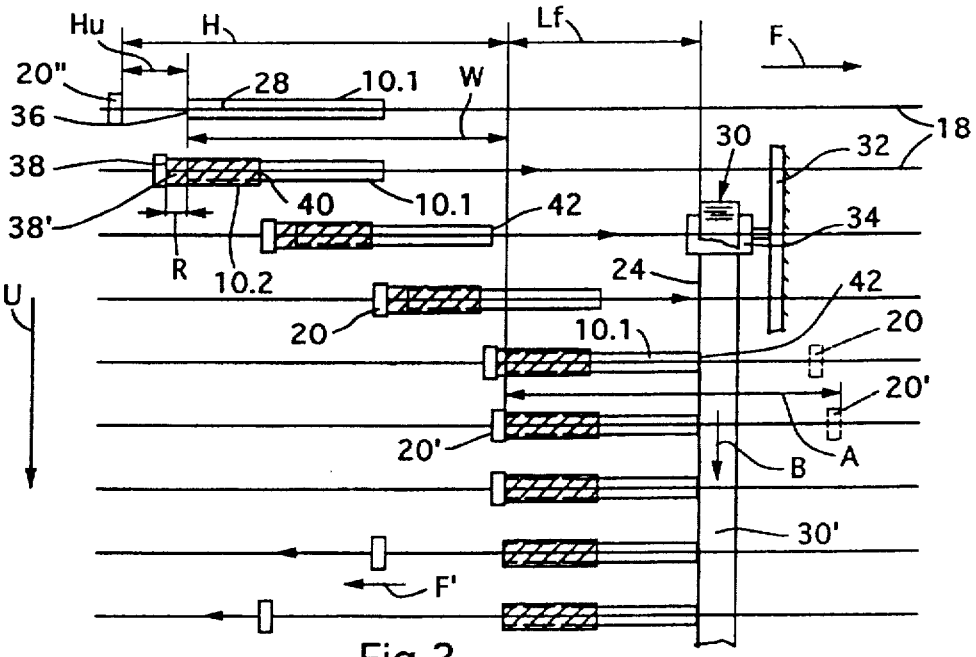
Fig.2
Fig.4
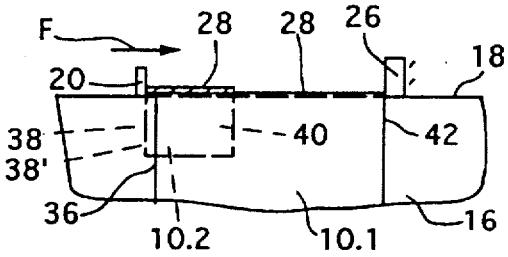
Fig.7
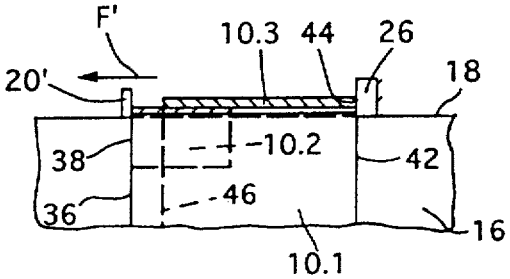
Fig.5
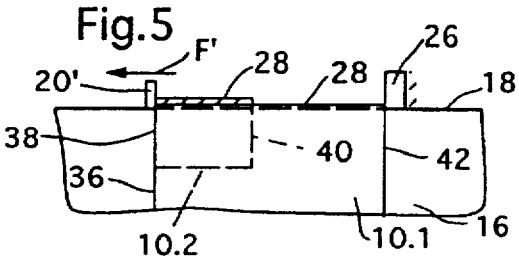
Fig.8
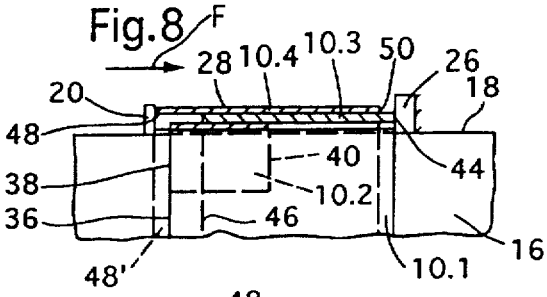
Fig.6
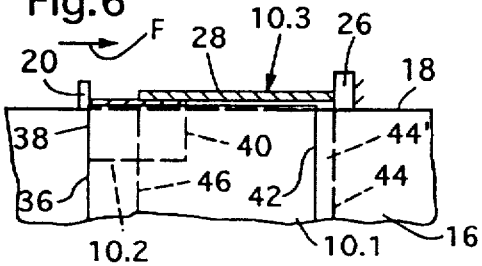
Fig.9
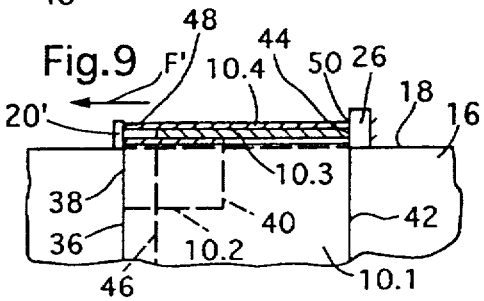

Fig.16
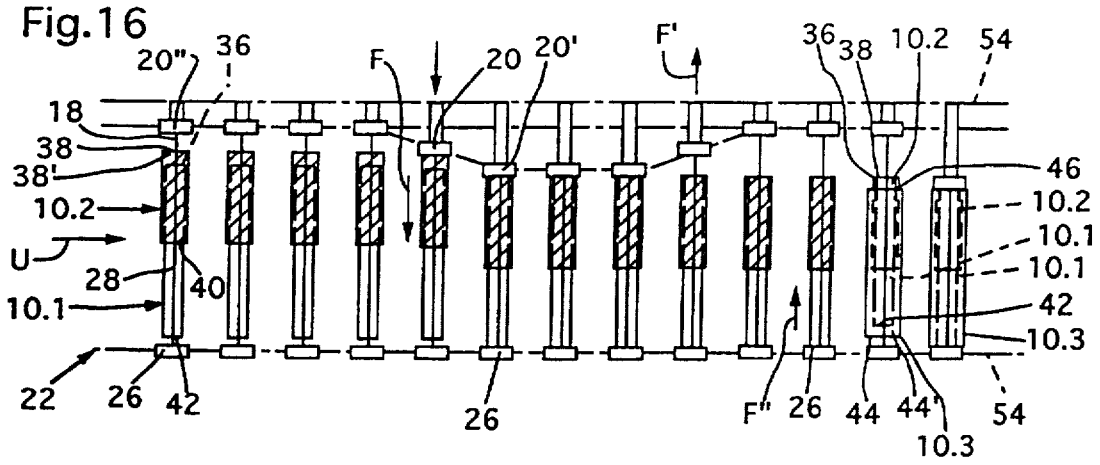
Fig.10
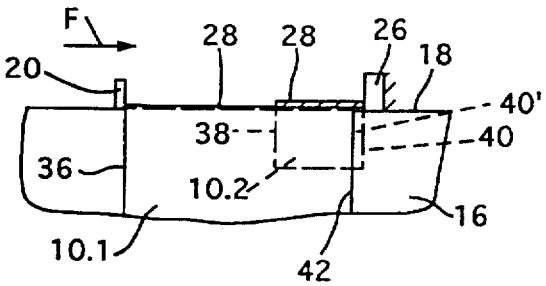
Fig.13
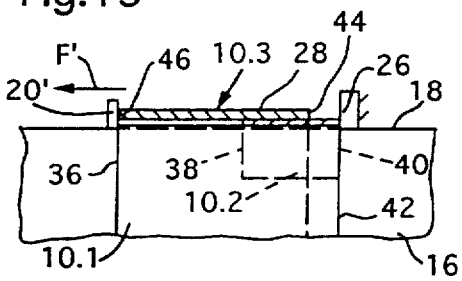
Fig.11
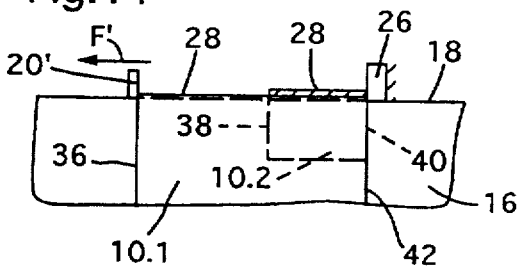
Fig.14
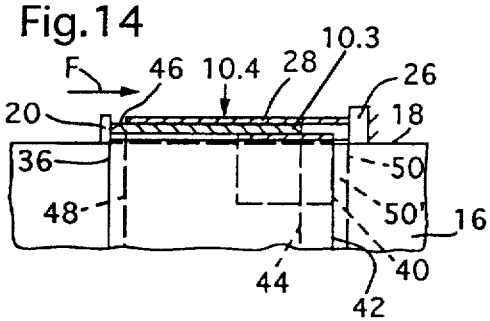
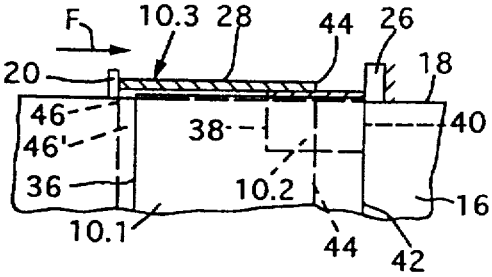
Fig.12
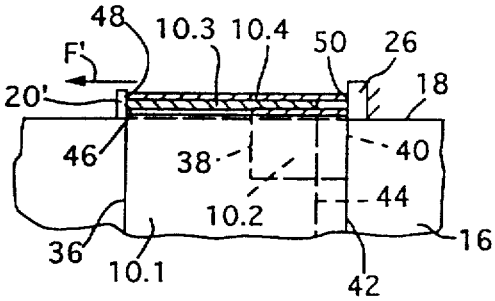
Fig.15

PROCESS AND APPARATUS FOR COLLECTING PRINTED PRODUCTS

BACKGROUND OF THE INVENTION

The present invention relates to a method and to an apparatus for collecting folded printed products which are deposited on rests which circulate along a continuous path.

A process and an apparatus of this type are known, for example, from U.S. Pat. No. 4,811,938 and the corresponding EP-A-0278286. The disclosed apparatus includes rests which are arranged about a circulation axis and are provided with continuously driven drivers. Feeding stations are arranged in the direction of the circulation axis, spaced apart one behind the other. At each feeding station one folded printed product is deposited in a straddling manner onto the rests which are moved past the feeding stations as they circulate about the circulation axis. When travelling between two feeding stations, the printed products thus circulate once about the circulation axis and are advanced by the relevant driver by the distance to the next feeding station. In this arrangement, the printed products must be deposited onto the passing rests such that they rest upstream of one of the oncoming, displacing drivers. This is not important for the first printed product because the first printed product remains on the rest until it is taken up by the corresponding driver, and only then is it advanced. However, each further printed product which is placed on a previously deposited printed product projects forward in the conveying direction with a border portion and, as a result of frictional locking, is advanced with the printed product located therebeneath from the moment it rests thereon, without the further printed product bearing directly on the displacing driver. In order then to align the printed products, which are of the same length in the direction of the rest, such that they coincide, each feeding station is assigned a stop element. The stop element forces in each case the last-deposited printed product against the displacing driver. The result is that the leading and trailing edges of the printed products which are collected on the rests to form groups are aligned one upon the other such that they coincide. This known apparatus is intended for collecting and aligning printed products of the same format. This apparatus, however, is not suitable for processing printed products of different formats, wherein the printed products are to be aligned with respect to one of the two fold-adjoining edges.

Furthermore, U.S. Pat. No. 4,058,202 and the corresponding CH-A-575303 disclose a drum-like apparatus for processing printed products. The disclosed apparatus includes radially outwardly open compartments running in the axial direction. In each partition wall, which separates one compartment from the next, a carriage is displaceably guided in the axial direction. The carriage forms the base of the relevant compartment and is provided with controllable sets of grippers. Feeding stations are arranged one behind the other in the direction of the circulation axis. At the feeding stations, a printed product is introduced into each compartment which runs past the feeding stations. In each case, during one revolution of the processing drum, the carriages carry out a conveying displacement and a return displacement. The sets of grippers are closed during the conveying displacement in order to convey the printed products from one feeding station to the next. During the return displacement, the sets of grippers are open, and the printed products are prevented, by stops arranged on the partition walls, from being carried along. In order to align the printed products assembled at the feeding station, the carriages included controlled stop fingers. During the return displacement, the stop fingers can be pivoted out in each case such that they project into the compartment, in order to force possibly excessively advanced printed products against the relevant stop.

Therefore, it is an object of the present invention to provide a process and apparatus which make it possible to process folded printed products of different formats, it being possible to align printed products with respect to one of the two fold-adjoining edges.

SUMMARY OF THE INVENTION

This and other objects are achieved by a method and apparatus for collecting folded printed products, wherein the printed products are deposited individually, at a plurality of feeding stations in a straddling manner on elongate rests which are driven in a circulating direction and spaced apart one behind the other in the circulating direction. Further printed products are deposited in an offset manner onto printed products which have already been deposited onto the rests. The further printed products are deposited with a border portion which projects beyond one of the edges of the already deposited printed products. The deposited printed products are advanced with drivers in a conveying direction which runs in the direction of the rests. The drivers are assigned to the rests and butt against a trailing edge of the printed products (as seen in the conveying direction). The leading edge of each of the printed products is forced against a stop element, in order to align printed products which have been deposited one upon the other in an offset manner. The drivers are driven such that they carry out a conveying displacement in the conveying direction and a return displacement in the opposite direction. The relevant drivers, at the end of the conveying displacement are spaced apart from the stop element by the length of the fold of the largest printed product. The further printed products are deposited before the drivers, in the conveying displacement, come to bear against the trailing edge of the printed products.

Due to the alternating movement of the drivers, the latter bear against the trailing edge, as seen in the conveying direction, of deposited printed products only over a certain section of a conveying displacement in each case. This ensures that both the trailing and the leading edges are free at certain times and thus further printed products to be deposited can be deposited such that they project beyond one of the two edges of the printed product which has already been deposited. The printed products, which were deposited in an offset manner, are then aligned with respect to their free fold-adjoining edge.

In a particularly preferred embodiment of the invention the largest printed product is deposited first. A second printed product, whose fold runs in the direction of the rest and which is shorter than that of the first printed product is deposited on the first largest printed product. Then, a third printed product is deposited on the first printed product such that it overlaps the second printed product. The third printed product is deposited such that it projects beyond the other edge of the first printed product from that beyond which the second printed product projects. This ensures that relatively short printed products are aligned and remain aligned, even if a further printed product is deposited thereon.

In another preferred embodiment of the invention, the printed products which are deposited one upon the other are aligned before a further printed product is deposited thereon. For alignment, all that has to be overcome in each case is the friction between the last-deposited printed product and the printed product arranged therebeneath, for which purpose only small forces are necessary, and careful handling of the printed products is thus ensured.

In another particularly preferred embodiment of the apparatus according to the invention the stop element runs along with the rests. This permits the play-free arrangement of the stop element with respect to the rests. This can thus prevent in particular thin printed products from being able to move through between the rest and stop element.

BRIEF DESCRIPTION OF THE DRAWINGS

The present invention will now be explained in more detail with reference to exemplary embodiments represented in the following drawings.

FIG. 2 shows a plan view of a detail of that part of the apparatus according to the embodiment of the invention which is shown in FIG. 1.

FIGS. 4 to 9 show, in elevation, in each case one rest of the apparatus shown in FIG. 1, the rests being shown at various points in time during the collection and alignment of printed products.

FIGS. 10 to 15 show, in the same representation as in FIGS. 4 to 9, that embodiment of the apparatus according to the invention which is shown in FIG. 3.

FIG. 16 shows a further embodiment of the apparatus according to the invention, having rests circulating along an elongate circulating conveyor.

DETAILED DESCRIPTION OF THE PRESENTLY PREFERRED EMBODIMENTS

Figure 1:
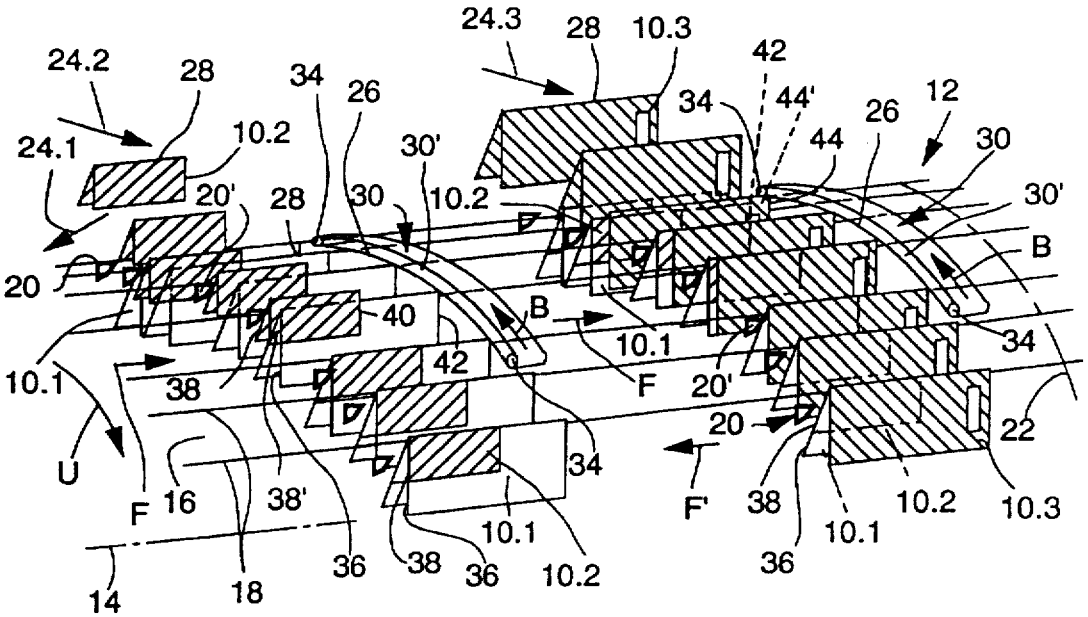
FIG. 1 shows, in perspective, part of an apparatus according to the invention, having rests which are arranged in a drum-like manner and onto which printed products are deposited in a straddling manner and then aligned.
Figure 3:
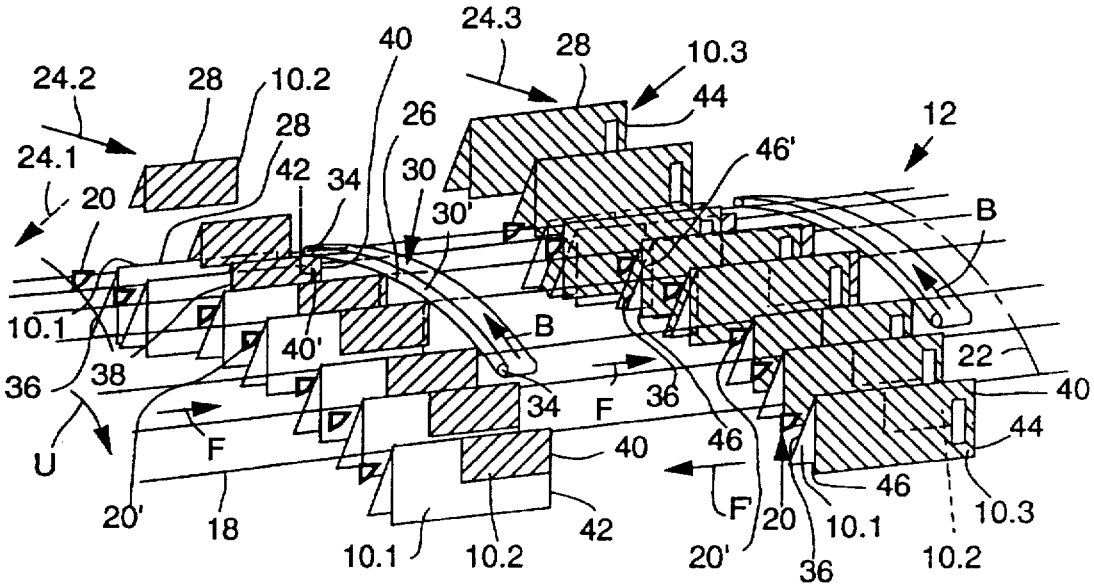
FIG. 3 shows, in the same representation of FIG. 1, the apparatus which is shown there, printed products being deposited differently.

The apparatus which is shown in part in FIGS. 1 to 3 and is intended for collecting printed products 10.1, 10.2, 10.3 includes a processing drum 12, as is disclosed in U.S. patent application Ser. No. 07/997,856 and the corresponding EP-A-0550828 which are incorporated herein by reference. For the construction and the mode of operation of the processing drum 12 reference is made to these documents. The drum has wall elements 16 which are arranged about a circulation axis 14 and run in the radial direction. The radially outer end regions of the wall elements form elongate, saddle-like rests which run parallel to the circulation axis 14 and are distributed uniformly in the circumferential direction.

Each rest 18 is assigned drivers 20 which, as seen in the longitudinal direction of the rest 18, are arranged one behind the other at a distance A. All the drivers 20 assigned to a rest 18 are driven such that, during circulation about the circulation axis 14 once in the longitudinal direction of the rests 18, they carry out a conveying displacement in the conveying direction F and a return displacement in the opposite direction F'. The length of the displacement is designated by H in FIG. 2 and is greater than the distance A between successive drivers 20 by an over-displacement designated by Hu.

The rests 18 circulate in a circular circulatory path 22 about the circulation axis 14. In the radial direction outside the circulatory path 22, a plurality of feeding stations 24 are arranged one behind the other in the direction of the circulation axis 14. In FIGS. 1 and 3, three of these feeding stations are indicated by an arrow and are designated by 24.1, 24.2 and 24.3. The feeding stations 24.1, 24.2, 24.3 deposit a folded printed product 10.1, 10.2, 10.3 in a straddling manner onto each rest 18 which runs past these feeding stations. The feeding stations 24.1, 24.2, 24.3 may be clamp-tight conveyors with an opening device. Such conveyors are disclosed, for example, in U.S. patent application Ser. No. 07/997,856 and the corresponding EP-A-0550828, or generally known feeders.

The feeding stations 24.2 and 24.3 are assigned a stop element 26. As seen in the circulating direction U, the stop element 26 is provided downstream of the relevant feeding station 24.2, 24.3. As seen in the direction of the circulation axis 14, the stop element 26 is arranged such that, between said stop element 26 and the driver 20 located in the end displacement position 20', there is a distance which corresponds to the length Lf of the fold 28, extending in the direction of the rest 18, of the largest printed product 10.1, 10.3 to be deposited onto the rest. In the present case, the length of the fold 28 is decisive for the "size" of a printed product 10.1, 10.2, 10.3. The stop element 26 is formed by the end side which is directed toward the corresponding drivers 20 and belongs to an endless stop belt 30. The stop belt 30 is guided around deflection rollers 34. The rollers 34 are spaced apart from one another in the circumferential direction and are mounted freely rotatably on a framework 32. The stop belt 30 bears, by means of its aligning strand 30' directed toward the processing drum 12, against the rests 18 which are located between the deflection rollers 34. Due to friction, the stop belt 30 is carried along in the circulating direction U by the rests 18, with the result that it circulates as indicated by the arrow B.

The first feeding station 24.1 deposits a first printed product 10.1 onto each rest 18 in each case. In the present case, the fold 28 of the printed products 10.1 is of a length Lf which corresponds to the largest format to be processed. When the printed products 10.1 are deposited, the drivers 20 are located in their initial displacement position 20". In this arrangement the drivers 20 are spaced apart from the trailing edge 36, as seen in the conveying direction F, of the relevant printed product 10.1 by the over-displacement Hu.

During the further rotation of the processing drum 12 in the circulating direction U, the drivers 20, starting from the initial displacement position 20", carry out a conveying displacement. After the drivers 20 run through the over-displacement Hu, they run onto the trailing edge 36 (as seen in the conveying direction F) of the printed product 10.1 and displace the printed product on the rest 18 in the conveying direction F by a conveying stretch W. Once the drivers 20 have reached the end displacement position 20', they are moved back into the initial displacement position 20" again. They thus carry out a return displacement in the process, while the advanced printed products 10.1 maintain their position, as seen in the direction of the circulation axis 14. This position is indicated by the printed product 10.1, which is located, in FIGS. 1 to 3, on the top rest 18 shown and, in FIGS. 1 and 3, beneath the feeding station 24.2. The depositing of the printed product 10.1 and the advancement thereof during a first revolution of the processing drum 12 is not shown in detail in FIGS. 1 to 3, but can be readily understood.

In the described position, the first printed products 10.1 are moved past the second feeding station 24.2. In each case the second feeding station deposits a second printed product 10.2 in a straddling manner onto the first printed product 10.1. As can be seen clearly in FIGS. 1 to 3, the length of the fold 28 of the said printed product 10.2 is smaller than the length Lf of the first printed products 10.1. In the case of the embodiment represented in FIGS. 1 and 2, the second printed products 10.2 are deposited onto the first printed products 10.1 such that they project with a border portion 38' (adjoining their trailing edge 38, counter to the conveying direction F) beyond the trailing edge 36 of the first printed product 10.1, i.e. on the foot side. As is shown clearly in FIG. 2, the length R, measured in the direction of the rests 18, of the border portion 38' is shorter than the over-displacement Hu. The result is that the trailing edge 38 comes to be located between the relevant driver 20 and the trailing edge 36.

In the case of the embodiment shown in FIG. 3, the second printed products 10.2 are deposited onto the first printed products 10.1 such that they project with a border portion 40' (adjoining the leading edge 40, in the conveying direction F) beyond the leading edge 42 of the first printed product 10.1, i.e. on the head side.

During the next conveying displacement of the drivers 20, the drivers 20 run onto the second printed product 10.2 (FIGS. 1 and 2) or onto the first printed product 10.1 (FIG. 3) and displace the printed products 10.1 and 10.2, which are deposited one upon the other, in the conveying direction F for alignment against the stop element 26.

During the return displacement, the drivers 20 following the advanced printed products 10.1, 10.2, 10.3 in each case move under the printed products 10.1, 10.2, which are present on the corresponding rest 18, without displacing said printed products. When the initial displacement position 20" is reached, the drivers 20 are then located in each case by an over-displacement Hu behind the aligned printed products 10.

During further rotation of the processing drum 12, the advanced and aligned printed products 10.1, 10.2 maintain their axial position. A third printed product 10.3 is deposited onto these printed products as they move past the feeding station 24.3. In the examples shown in FIGS. 1 and 3, the printed product 10.3 is of the same format as the first printed product 10.1.

In accordance with FIG. 1, the third printed products 10.3 are deposited onto the printed products 10.1 and 10.2 which are already located on the rests 18, such that they project with a border portion 44' (adjoining their leading edge 44, in the conveying direction F) beyond the printed product 10.1. Conversely, in accordance with FIG. 3, the third printed products 10.3 are deposited there such that they project with a border portion 46' (adjoining their trailing edge 46, counter to the conveying direction F) beyond the first printed product 10.1. Analogously, as has been described above, the three printed products 10.1, 10.2, 10.3, which are deposited one upon the other, are then advanced during the next conveying displacement of the drivers 20. These three printed products 10.1, 10.2, 10.3 are aligned toward the end of the conveying displacement, interacting with the relevant stop element 26 in the process. The result is that, at the end of this conveying displacement, the first and third printed products 10.1, 10.3 are located one upon the other such that they coincide. The second printed product 10.2 remains with its trailing edge 38 or leading edge 40 aligned with the trailing edge 36 or leading edge 42, respectively, of the first printed product 10.1.

The collected and aligned finished products can then be received by a removal conveyor and transported away from the processing drum 12. If, on the other hand, yet further printed products are to be deposited onto the printed products 10.1, 10.2, 10.3 collected in accordance with FIGS. 1 and 3, then, analogously, the printed products are, for this purpose, advanced further in the conveying direction F in a stepwise manner.

Alignment of the printed products 10 in the case of the embodiment shown in FIGS. 1 and 2 will now be described in more detail with reference to FIGS. 4 to 9. These Figures each show part of a wall element 16, which forms a rest 18, a driver 20 and a stop element 26. The respectively first printed product 10.1 deposited onto the rest 18 is represented by solid lines. The subsequently deposited printed products 10.2, 10.3, etc. are shown by broken lines along their fold 28.

The second printed product 10.2 projects, in the direction F', with its border portion 38' beyond the trailing edge 36 of the first printed product 10.1, counter to the conveying direction F. During a conveying displacement, the relevant driver 20 takes up the second printed product 10.2, comes to bear against the trailing edge 38 thereof and displaces it forward in the conveying direction F. With frictional locking, the first printed product 10.1 is also displaced along therewith until it comes to bear against the stop element 26 with its leading edge 42, as is shown in FIG. 4. Since the driver 20 is capable of further displacement action until it has reached the end displacement position 20' (FIG. 5), the friction between the two printed products 10.1, 10.2 is then overcome and the second printed product 10.2 is advanced in the conveying direction F until its trailing edge 38 is aligned with the trailing edge 36 of the first printed product 10.1. This is because, in the end displacement position 20', the driver 20 is spaced apart from the stop element 26 by the length Lf of the fold 28 of the first printed product 10.1.

In accordance with FIG. 1, in the case of the third feeding station 24.3, the third printed product 10.3 is deposited in each case onto the printed products 10.1 and 10.2 (which have already been deposited onto the rest 18 and aligned). The third printed product 10.3 is deposited such that it projects with its border portion 44' beyond the leading edge 42 of the first printed product 10.1. During the following conveying displacement, the relevant driver 20 runs onto the first and second printed product 10.1, 10.2 and displaces these in the conveying direction F. In this arrangement, the third printed product 10.3 is, due to friction, carried along therewith until it comes to bear against the relevant stop element 26 with its leading edge 44 (FIG. 6). During further displacement of the first and second printed products 10.1, 10.2, the third printed product 10.3 is, then, forced back counter to the first and second printed products until the leading edge 42 of the first printed product 10.1 also bears against the stop element 26 (FIG. 7). Due to the overlapping of the second and third printed products 10.2, 10.3, the printed products can readily be displaced with respect to one another. In accordance with FIGS. 6 and 7, the fold 28 of the third printed product 10.3 is of a shorter length than the fold 28 of the first printed product 10.1. However, as is shown in FIG. 1, if the folds of these two printed products 10.1, 10.3 are of the same length, then they are now aligned with respect to both fold-adjoining leading edges 42, 44 and trailing edges 36, 46.

If the finished product to be formed is to have yet a further printed product 10.4, during a further revolution of the processing drum 12, this further printed product is deposited at a further feeding station in a straddling manner onto the printed products 10.1, 10.2, 10.3 which have already been deposited one upon the other and aligned. The further printed product 10.4 is deposited such that it projects with a border portion 48' (adjoining its trailing edge 48, counter to the conveying direction F) beyond the trailing edge 36 of the first printed product 10.1. During a subsequent conveying displacement, the relevant driver 20, acting on the trailing edge 48 of the fourth printed product 10.4, then displaces the printed product 10.4 in the conveying direction F. The other printed products 10.1, 10.2, 10.3 are moved along with the printed product 10.4 frictionally until the first printed product 10.1 and the third printed product 10.3 come to bear on the stop element 26 with their leading edge 42 and leading edge 44, respectively (FIG. 8). Subsequently, the friction being overcome, the fourth printed product 10.4 is advanced until its trailing edge 48 is aligned with the trailing edge 36 of the first printed products 10.1. In this arrangement, the mutual position of the printed products 10.1, 10.2 and 10.3 remains unchanged. If the length of the fold 28 of the fourth printed product 10.4 is the same as that of the first printed product 10.1, then the fourth printed product 10.4 likewise bears against the stop element 26 with its leading edge 50 (FIG. 9).

In the same representation as in FIGS. 4 to 9, alignment with respect to the embodiment shown in FIG. 3 will now be described in more detail with reference to FIGS. 10 to 15. As is shown in FIG. 3, the second printed product 10.2 is deposited onto the first printed product 10.1 such that it projects with its border portion 40' beyond the leading edge 42 of the first printed product 10.1. During the subsequent conveying displacement, the driver 20 takes up the first printed product 10.1 and displaces it forward. The second printed product 10.2 is moved along with it frictionally until the second printed product 10.2 comes to bear against the stop element 26 with its leading edge 40 (FIG. 10). During the subsequent further displacement of the first printed product 10.1, the second printed product 10.2 is, then, forced back with respect to the first printed product 10.1 until the first printed product 10.1 also bears against the stop element 26 with its leading edge 42 (FIG. 11). Thereafter, the driver 20 then moves back, counter to the conveying direction F, out of the end displacement position 20' reached into the initial displacement position 20", in direction F'.

The third feeding station 24.3 (FIG. 3) deposits the third printed product 10.3 onto the first and the second printed product 10.1, 10.2 such that it projects with a border portion 46' (adjoining the trailing edge 46, counter to the conveying direction F) beyond the trailing edge 36 of the first printed product 10.1. The driver 20 which then comes to bear against the trailing edge 46 then displaces the third printed product 10.3, and frictionally displaces the printed products 10.1 and 10.2, in the conveying direction F. The result is that the two last-mentioned printed products come to bear against the stop element 26 with their leading edge 42 and the leading edge 40, respectively (FIG. 12). Due to the further advancement of the third printed product 10.3, the third printed product 10.3 is then displaced with respect to the retained printed products 10.1 and 10.2 located beneath until its trailing edge 46 is aligned with the trailing edge 36 of the first printed product 10.1 (FIG. 13). If the third printed product 10.3 is of the same format as the first printed product 10.1 (as is the case in the example shown in FIG. 3) the third printed product 10.3 also has its leading edge 44 aligned with the leading edge 42 of the first printed product 10.1.

If a further folded printed product 10.4 is to be deposited onto the printed products 10.1, 10.2, 10.3 which have been collected and aligned in this manner, this takes place at a further feeding station. Hence, the further folder printed product 10.4 is deposited such that the printed product 10.4 projects with a border portion 50' (adjoining its leading edge 50, in the conveying direction F) beyond the leading edge 42 of the first printed product 10.1. The driver 20 carrying out a conveying displacement then displaces the four printed products 10.1, 10.2, 10.3, 10.4 (located one upon the other) in the conveying direction F. The driver 20 acts on the first and third printed products 10.1, 10.3 in the process, wherein the fourth printed product 10.4 then comes to butt against the stop element 26 with its leading edge 50 (FIG. 14). As the rest of the printed products 10.1, 10.2, 10.3 are displaced further forward until the first two printed products 10.1, 10.2 likewise bear against the stop element 26, the fourth printed product 10.4, overcoming frictional locking, is forced back by the stop element 26 (FIG. 15).

Since, in the example shown, the folds 28 of the first printed product 10.1 and the fourth printed product 10.4 are of the same length, the fourth printed product 10.4 also has its trailing edge 48 aligned with the trailing edge 36 of the first printed product 10.1.

In the example shown in FIGS. 1 and 2, should the friction between the second printed product 10.2 and the first printed product 10.1 be smaller than the friction between said first printed product 10.1 and the rest 18, then as a result of the displacing action of the driver 20, the second printed product 10.2 is displaced with respect to the first printed product 10.1 until the driver 20 also effects displacement of the first printed product 10.1. This also means that the trailing edge 38 of the second printed product 10.2 is aligned with the trailing edge 36 of the first printed product 10.1, and the position shown in FIG. 5 is also reached.

In the exemplary embodiment shown in FIG. 3, should the friction between the rest 18 and the first printed product 10.1 be greater than between the first printed product 10.1 and the third printed product 10.3, the latter is displaced with respect to the first printed product 10.1 until the driver 20 also effects displacement of the trailing edge 36 of the first printed product 10.1. Should the friction between the first printed product 10.1 and second printed product 10.2 be smaller than between the second printed product 10.2 and the third printed product 10.3, the second printed product 10.2 is also displaced along in the conveying direction F during the relative displacement between the first and the third printed products 10.1, 10.3. The result is that the second printed product 10.2, in turn, projects beyond the leading edge 42 of the first printed product 10.1. It is, however, forced back again as soon as the stop element 26 takes effect. The result is that the position of the printed products which is shown in FIG. 13 is also, ultimately, achieved again.

FIG. 16 shows a further embodiment of the apparatus for collecting printed products 10. In this embodiment, the saddle-like rests 18 are arranged in a ladder-like manner on two parallel, endless drawing members 54. The drawing members 54 are guided around two spaced-apart deflection members (not shown). The result is that the circulatory path 22 of the rests 18 between the deflection members runs essentially in a rectilinear manner. In the same way as is described in conjunction with FIGS. 1 to 3, a first printed product 10.1 is deposited at a first feeding station and a second printed product 10.2 is deposited onto the printed product 10.1 at a second feeding station. The second printed product 10.2 projects with a border portion 38' beyond the trailing edge 36 (as seen in the conveying direction F) of the first printed product 10.1. In order to make it more easily discernible, the second printed product 10.2 is hatched in FIG. 16.

Each rest 18 is assigned a driver 20. As the rests 18 circulate in the circulating direction U, the driver 20 is displaced in the conveying direction F in a section of the circulatory path 22. In this arrangement, the driver 20 temporarily comes to bear against the second printed product 10.2. Thereupon, the second printed product 10.2 is displaced and the first printed product 10.1 is also displaced, frictionally, until the latter bears against a stop element 26, assigned to the rest 18, with its leading edge 42. Due to the further displacement of the second printed product 10.2 by the driver 20, the second printed product 10.2 is displaced with respect to the first printed product 10.1 until the trailing edge 38 is aligned with the trailing edge 36. This is the case when the driver 20 has reached its end displacement position 20', which is spaced apart from the stop element 26 by the length of the fold 28 of the first printed product 10.1. In a subsequent section of the circulatory path 22, the driver 20 is moved back into its initial displacement position 20" by a return displacement in the direction F'. As is indicated by the arrow F", the aligned printed products 10.1, 10.2 (by displacement of the corresponding stop elements 26) are displaced back counter to the conveying direction F by a certain stretch. The result is that, when moving past a third feeding station, a third printed product 10.3 can be deposited such that its leading edge 44 (as seen in the conveying direction F) comes to be located between the stop element 26 (which has now been drawn back again) and the leading edge 42 of the first printed product 10.1. Thus, the third printed product projects with a border portion 44' beyond the first printed product 10.1. For the subsequent alignment, the relevant driver 20 is in turn advanced in the conveying direction F by a conveying displacement. The driver comes to bear against the first and second printed products 10.1, 10.2 and effects displacement thereof. In this arrangement, the third printed product 10.3 is carried along frictionally therewith until it bears against the stop element 26 with its leading edge 44 and is retained counter to the frictional force by the stop element 26. The first and second printed products 10.1, 10.2 are further advanced until the first printed product 10.1 bears against the stop element 26 with its leading edge 42. The smaller-format second printed product 10.2 thus has its trailing edge 38 aligned with the trailing edge 36 of the first printed product 10.1. The third printed product 10.3 has its leading edge 44 aligned with the leading edge 42 of the first printed product 10.1. If, as in the example shown, the first and third printed products 10.1, 10.3 are of the same format, the third printed product 10.3 then also has its trailing edge 46 aligned with the trailing edge 36 of the first printed product 10.1.

It is, of course, also conceivable, in the case of an embodiment similar to FIG. 16, to design the rests 18 to be longer and, in this arrangement, analogously to the examples shown in FIGS. 1 to 3, to advance the deposited printed products 10.1, 10.2, 10.3 in the conveying direction F in a stepwise manner.

In all of the exemplary embodiments shown, the first printed product 10.1 is of a format which corresponds to the largest format to be processed. The subsequent printed products 10.2, 10.3, 10.4 are then alternately deposited such that they project beyond the leading and trailing edges 36, 42. It is also conceivable to deposit a smaller printed product as the first printed product. This is then aligned with respect to its trailing edge (as seen in the conveying direction F).

It is possible to design the stop element 36 differently. It is thus conceivable to provide, in the interior of each wall element 16, stop pins which can be displaced in the radial direction, can be extended to project beyond the rest 18 in order to align the printed products 10.1, 10.2, 10.3, 10.4, and can be retracted back into the wall elements 16 again after the alignment.

It will be understood that a wide range of changes and modifications to the embodiments described above will be apparent to those skilled in the art, and are also contemplated. It is therefore intended that the foregoing detailed description be regarded as illustrative rather than limiting, and that it be understood that it is the following claims, including all equivalents which are intended to define the spirit and scope of this invention.

I claim:

1. A method for collecting folded printed products, wherein the printed products are deposited individually, at a plurality of feeding stations in a straddling manner on elongate rests which are driven in a circulating direction and spaced apart one behind the other in the circulating direction; the method comprising the steps of:

depositing further printed products in an offset manner onto printed products which have already been deposited onto the rests, the further printed products being deposited with a border portion projecting beyond one of the edges of the already deposited printed products;

advancing the deposited printed products step by step with drivers in a conveying direction running in the direction of the rests, the drivers being assigned to the rests and butting against a trailing edge of the printed products, as seen in the conveying direction;

forcing the leading edge of the printed products against a stop element, in order to align printed products which have been deposited one upon the other in an offset manner; and driving the drivers such that they carry out a conveying displacement in the conveying direction and a return displacement in the opposite direction, the relevant drivers, at the end of the conveying displacement, being spaced apart from the stop element by the length of the fold of the largest printed product, the relevant drivers, at the end of the return displacement, being spaced apart from the printed products to be advanced, the further printed products being deposited before the drivers, in the conveying displacement, come to bear against the trailing edge of the printed products.

2. The method as claimed in claim 1, comprising depositing on a largest first printed product, a second printed product, whose fold, running in the direction of the rest, is shorter than that of the first printed product, and then depositing a third printed product on said first printed product such that it overlaps the second printed product, the third printed product being deposited such that it projects beyond the other edge of the first printed product from that beyond which the second printed product projects.

3. The method as claimed in claim 1, wherein the printed products are advanced in each case before a further printed product is deposited thereon.

4. An apparatus for collecting folded printed products comprising:

a plurality of elongate rests which are driven in a circulating direction along a continuous circulatory path and spaced apart one behind the other in the circulating direction, the printed products being deposited at a plurality of feeding stations in a straddling manner on said rests;

a stop element;

a plurality of drivers which are assigned to the rests and advance the deposited printed products step by step, in a conveying direction running in the direction of the rests, by butting against a trailing edge, as seen in the conveying direction, and forcing said printed products against the stop element with a leading edge, in order to align printed products which have been deposited one upon the other in an offset manner;

wherein the drivers are driven such that they carry out a conveying displacement in the conveying direction and a return displacement in the opposite direction, the relevant drivers, at the end of the conveying displacement, being spaced apart from the stop element by the length of the fold of the largest printed product, the relevant drivers, at the end of the return displacement, being spaced apart from the printed products to be advanced, and wherein the feeding stations deposit printed products to be deposited on printed products which have already been deposited onto the rests with a border portion projecting beyond the leading or trailing edge before the drivers, in the conveying displacement, come to bear against the trailing edge.

5. The apparatus as claimed in claim 4, wherein the stop element is formed in a section of the circulatory path such that it runs along with the rests.

6. The apparatus as claimed in claim 5, wherein the stop element includes an endless member, which is guided, at the beginning and at the end of the section of the circulatory path, around deflection rollers and bears against the rests with an aligning strand.

7. The apparatus as claimed in claim 6, wherein the endless member comprises a stop belt.

8. The apparatus as claimed in claim 4 comprising three feeding stations, provided downstream of one another, the three feeding stations arranged to be offset with respect to one another in the direction transverse to the circulating direction, such that the second feeding station deposits a second printed product, whose fold is shorter than that of the first printed product, deposited by a first feeding station, and the third feeding station deposits a third printed product such that it overlaps the second printed product, the third printed product being deposited such that it projects beyond the other edge of the first printed product from that beyond which the second printed product projects.

9. The apparatus as claimed in claim 4, wherein, after a rest has moved past each feeding station, the drivers assigned to said rest carry out a conveying displacement in each case, and, as seen in the circulating direction, in each case one stop element is provided downstream of the feeding stations provided downstream of the feeding station which deposits a first printed product onto the rests.

10. The apparatus as claimed claim 4, wherein the rests are arranged one behind the other in the manner of a drum about a common circulation axis and the feeding stations are arranged one behind the other in the direction of the circulation axis, and the drivers, during in each case one revolution about the circulation axis, carry out one conveying displacement and one return displacement, in order to convey the printed products in a stepwise manner from one feeding station to the next.

* * * * *

UNITED STATES PATENT AND TRADEMARK OFFICE

CERTIFICATE OF CORRECTION

PATENT NO. : 5,593,148

DATED : January 14, 1997

INVENTOR(S) : Egon Hansch

It is certified that error appears in the above-indentified patent and that said Letters Patent is hereby corrected as shown below:

Column 12, line 19,

In Claim 10, line 1, after "claimed" insert --in--.

Signed and Sealed this

Eighth Day of July, 1997

Bruce Lehman

*Attest:*

BRUCE LEHMAN

*Attesting Officer*

*Commissioner of Patents and Trademarks*